United States Patent [19]

Bourdo

[11] 4,046,040

[45] Sept. 6, 1977

[54] PROGRESSIVE DIE SENSOR

[76] Inventor: Charles A. Bourdo, 3301 Willet, Pontiac, Mich. 48057

[21] Appl. No.: 702,554

[22] Filed: July 6, 1976

[51] Int. Cl.[2] ..... B26D 7/22

[52] U.S. Cl. ..... 83/63; 192/125 A; 192/127

[58] Field of Search ..... 83/61, 62, 67, 63; 192/125 A, 127, 129 A, 143; 200/61.42

[56] References Cited

U.S. PATENT DOCUMENTS

| | | | |
|---|---|---|---|
| 2,134,933 | 11/1938 | Smith | 192/125 A |
| 2,821,251 | 1/1958 | Borke | 192/127 X |
| 2,986,254 | 5/1961 | Borke | 83/67 X |
| 3,124,026 | 3/1964 | Loeffel | 192/127 X |
| 3,440,909 | 4/1969 | Schmid et al. | 83/61 |

*Primary Examiner*—J. M. Meister

*Attorney, Agent, or Firm*—Reising, Ethington, Barnard

[57] ABSTRACT

A progressive die sensor of the disclosure for sensing an unaligned workpiece condition includes a housing having an upper mounting surface engaged with an upper punch holder during mounting. A depression in the mounting surface is located in a spaced relationship to a downwardly extending probe that moves relative to the housing to indicate an unaligned workpiece condition. A switch received within the depression includes an actuating plunger that is moved by a push rod in response to the probe movement to cause switch actuation for generating an electrical signal which indicates the occurrence of the unaligned workpiece condition. A switch cover is received within the depression to cover the switch. The housing depression preferably opens upwardly and the switch cover includes downwardly extending side portions that receive the switch therebetween intermediate opposite sides of the switch depression. Between its opposite sides, the depression preferably has a rectangular cross section that is closed by the side portions of the cover. Positioning posts mounted on the cover locate the switch within the depression against relative movement with respect to the housing. A gasket engages the side portions of the cover to provide sealing of the depression.

7 Claims, 3 Drawing Figures

PROGRESSIVE DIE SENSOR

BACKGROUND OF THE INVENTION

1. Field of the Invention

This invention relates to progressive die sensors utilized to indicate an unaligned condition of a workpiece strip being stamped during a progressive stamping operation.

2. Description of the Prior Art

Progressive dies are used in manufacturing to perform stamping operations on a continuous workpiece strip. A number of work stations are arranged along a path through which the strip is continuously fed. Punches and cooperable female die sections are mounted at the various work stations so that vertical stamping movement of an upper punch holder causes deformation of the workpiece. Usually, the punches are mounted on an upper punch holder which is moved vertically with respect to a lower shoe that mounts the female sections.

At the first station of a progressive die stamping operation, a guide hole is pierced in the workpiece strip such that a probe located at a subsequent station can sense whether there is a properly aligned condition between the work stations and the workpiece strip. Vertical stamping movement of the upper punch holder has also been terminated by the alignment sensing probe when an unaligned workpiece condition is detected. However, this termination of the stamping operation has required the design, fabrication and assembly for each job of a sensor for detecting when the probe moves in response to an unaligned workpiece condition. Such design and assembly, of course, results in considerable labor and consequent expense.

SUMMARY OF THE INVENTION

An object of the present invention is to provide an improved progressive die sensor which is readily mounted for use to sense an unaligned workpiece condition.

The progressive die sensor includes a housing having an upper mounting surface that engages an upper punch holder during mounting thereon. A depression in the housing is located in a spaced relationship to a probe that is mounted on the housing for relative movement with respect thereto to indicate an unaligned workpiece condition. A switch including a plunger is secured within the depression and enclosed by a cover with a push rod extending between the probe and the switch plunger to actuate the switch in response to probe movement indicating an unaligned workpiece condition. Switch actuation in this manner allows an electrical signal to be generated when such an unaligned workpiece condition occurs to terminate the progressive die stamping operation.

Preferably, the depression in the sensor housing has an upwardly opening orientation and the housing includes lateral side surfaces with the depression having opposite sides that open to the side surfaces. Downwardly extending side portions of the switch cover are located at the opposite sides of the housing depression in a spaced relationship to each other to receive the switch therebetween with positioning posts on the cover received by suitable apertures in the switch to properly locate the switch within the depression. Between its opposite sides at the lateral side surfaces of the housing, the depression has a rectangular cross section and the cover side portions have complementary rectangular shapes sealing the opposite sides of the depression. A gasket may be utilized to seal between the side portions of the cover and the opposite sides of the housing depression.

The sensor housing of the preferred embodiment includes a push rod hole receiving the push rod and opening to the depression between the side portions of the switch cover. A seat of the push rod hole normally seats an annular flange of the push rod under a spring bias with a first end of the push rod engaging the switch plunger and with a second end thereof located adjacent the probe. Probe movement relative to the housing cams the second end of the push rod so that its annular flange disengages the seat of the push rod hole while its first end depresses the switch plunger to cause the switch actuation that indicates the occurrence of an unaligned workpiece condition.

The sensor housing has a rounded end that mounts the probe and a squared end receiving an electrical cable connected to the switch. An electrical cable hole communicates with the depression and the environment to allow the cable to be connected to the switch and to carry an electrical signal generated by the switch actuation in response to an unaligned workpiece condition.

The objects, features and advantages of the present invention are readily apparent from the following detailed description of the preferred embodiment taken in connection with the accompanying drawings.

DETAILED DESCRIPTION OF THE PREFERRED EMBODIMENT

Figure 1:
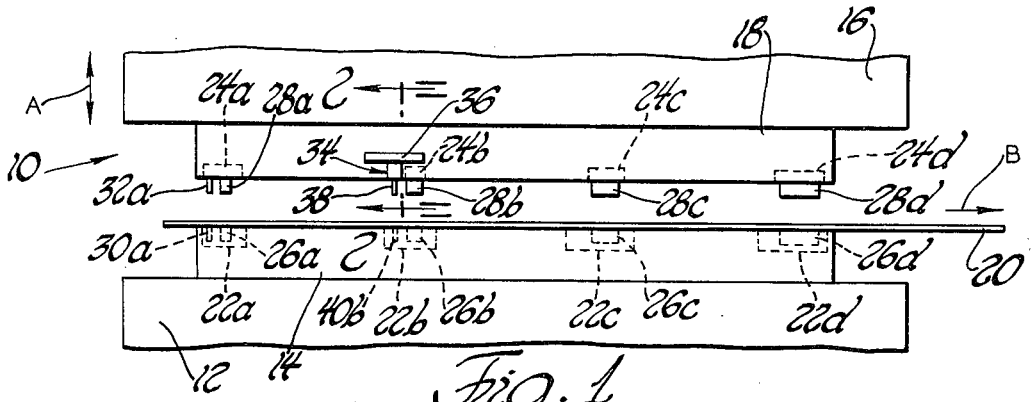
FIG. 1 is a side elevation view of a progressive die set that incorporates a sensor constructed according to the present invention to sense an unaligned workpiece condition.

With reference to FIG. 1, a progressive die set is collectively indicated by 10. A lower press bed 12 supports a lower shoe 14 of the die set and a ram 16 supports an upper punch holder 18 of the die set. Suitable unshown mechanism is provided to reciprocate the ram 16 as shown by arrow A in order to perform a progressive stamping operation on a workpiece strip 20 that is advanced through the machine in the direction shown by arrow B. Female die sections **22*a*, 22*b*, 22*c*, and 22*d* and male punches 24*a*, 24*b*, 24*c*, and 24*d* are respectively mounted on the lower shoe and the upper punch holder in a conventional manner along four work stations of the machine at locations above and below the workpiece strip 20. The female die sections define cavities 26*a*, 26*b*, 26*c*, and 26*d* of progressively increasing size for receiving male die punch portions 28*a*, 28*b*, 28*c*, and 28*d* of progressively increasing size in order to perform a progressive stamping operation on the workpiece strip 20. A guide hole 30*a* in the female die sections 22*a* and a cooperable guide punch portion 32*a* of the punch 24*a* pierce a guide hole in the workpiece strip 20 during the stamping operation at the first station. At the second station, a sensor 34 mounted on a support 36 of the upper punch holder includes a probe 38 that is received within the guide hole formed in the workpiece strip 20 and within a probe hole 40b of the female die secion 22*b* in order to sense whether there is a properly aligned workpiece condition. If the workpiece strip 20 is not aligned properly, the probe 38** will engage the workpiece strip and move relative to the upper punch holder to indicate the occurrence of this unaligned workpiece condition in a manner that is described later.

Figure 2:
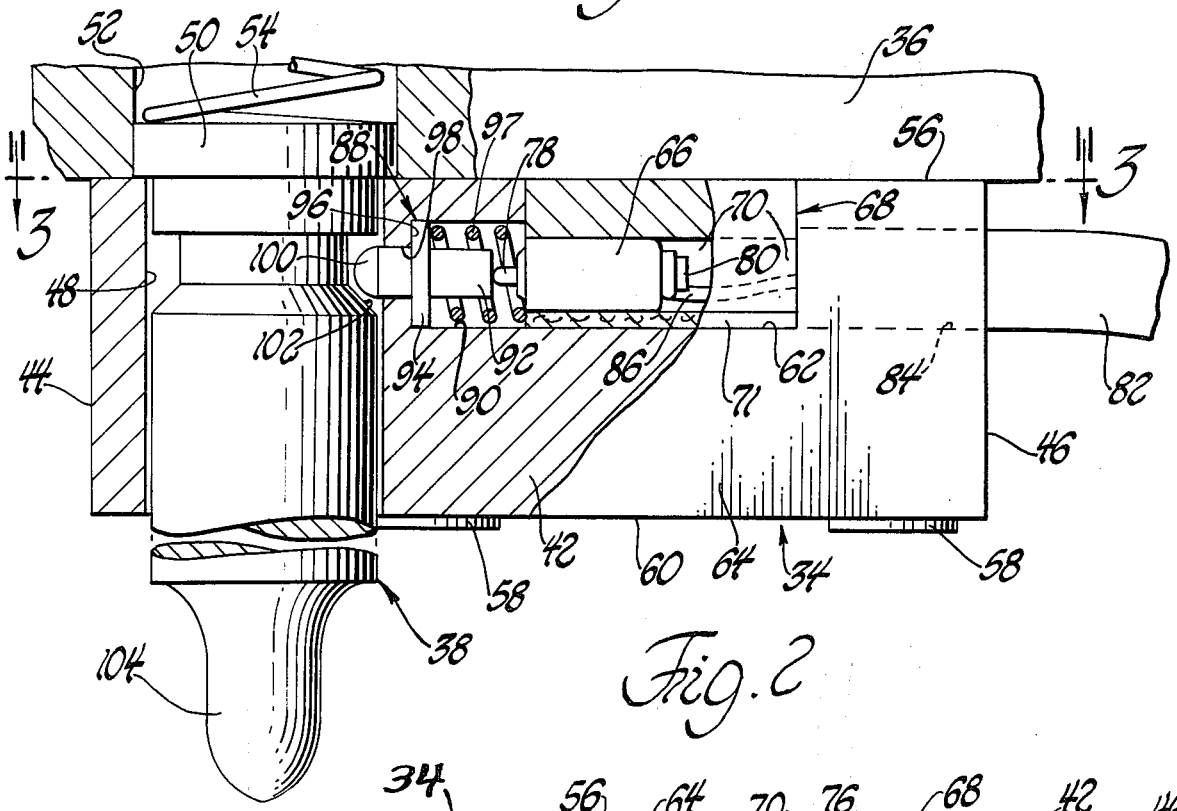
FIG. 2 is a partially sectioned view taken in elevation along line 2—2 of FIG. 1 to show the sensor.
Figure 3:
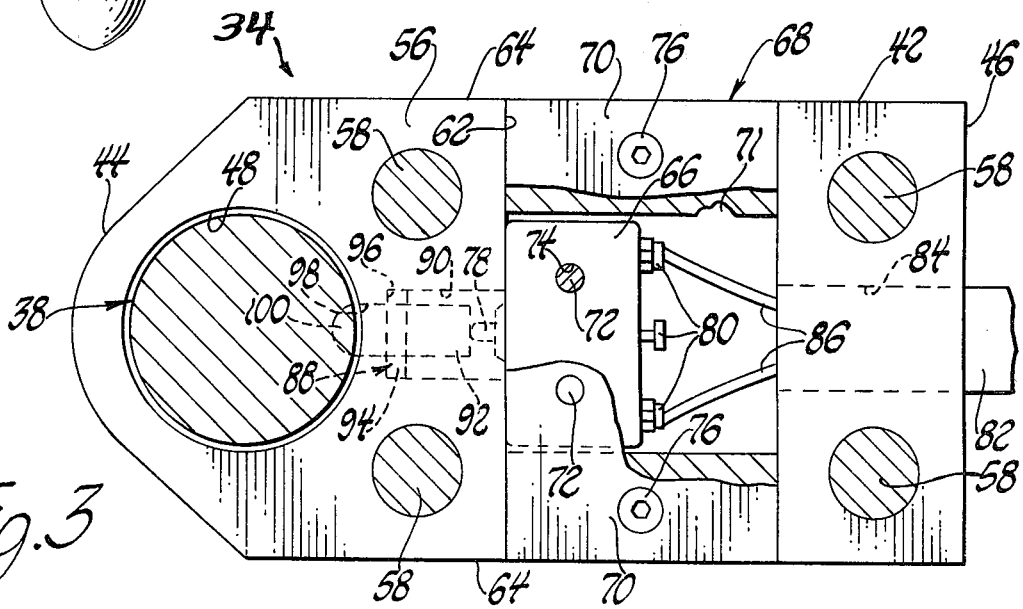
FIG. 3 is a partially broken away view taken in a plan direction along line 3—3 of FIG. 2 to show the sensor.

FIGS. 2 and 3 illustrate the progressive die sensor 34 which includes a metallic housing 42 that is slightly elongated with a first end 44 that is of a round shape when viewed in the plan direction and a second end 46 that is squared off at right angles when viewed in this direction. Probe 38 is mounted within a vertical aperture 48 in the rounded housing end 44 such that an upper end 50 of the probe is received within an aperture 52 in the punch holder support 36 to be biased downwardly by a helical spring 54. An upper mounting surface 56 of sensor housing 42 engages the lower side of punch holder support 36 in the mounted condition shown and is secured in its relationship by four bolts 58 whose heads are partially recessed into a lower housing surface 60. Between the first and second housing ends 44 and 46, a depression 62 in the upper housing surface 56 opens upwardly toward support 36. Depression 62 extends between opposite lateral side surfaces 64 of the sensor housing with opposite sides located adjacent these side surfaces and has a rectangular cross section therebetween as can be seen in FIG. 2.

A switch 66 is received within the housing depression 62 and enclosed by a metal or plastic cover 68 also received within the depression. The cover has side portions 70 located adjacent the lateral housing surfaces 64 extending downwardly in a spaced relationship to each other with the switch received therebetween. A gasket 71 engages the lower sides of the cover side portions 71 to provide sealing of the depression such that the switch does not become contaminated by lubricating fluid that is used during the progressive stamping operation. If the cover 68 is made from metal, it is best to use the gasket 71 to achieve proper sealing, however, the required sealing is possible without the gasket if the cover is made from plastic.

Positioning posts 72 of the cover 68 extend downwardly into suitable apertures 74 in switch 66 to locate the switch with respect to the cover 68 and screws 76 secure the cover with respect to the sensor housing 42. Switch 66 includes an actuating plunger 78 at one side and contacts 80 at its other side. An electrical cable 82 extends into the switch depression through a cable hole 84 in the squared housing end 46 and has wires 86 connected to appropriate switch contacts. Plunger 78 is depressed to the right to actuate switch 66 and thereby generate a suitable electrical signal through the cable wires 86. This electrical signal may comprise the commencement of a current flow or the termination of a previously flowing current. A push rod 88 is received within a push rod hole 90 that opens into the depression 62 to receive the switch plunger 78. A first end 92 of push rod 88 normally engages the switch plunger 78 as shown with an annular flange 94 of the push rod engaged with an annular seat 96 of the push rod hole by a spring 97. Within the annular configuration of the push rod seat 96, housing 42 defines an opening 98 through which a second rounded end 100 of the push rod extends into proximity with a frustoconical control surface 102 of probe 38.

During normal progressive die stamping when the workpiece strip is advanced to the proper position, probe 38 moves through the guide hole in the workpiece strip and remains positioned relative to the sensor housing 42 with its upper end 50 engaged with the upper housing mounting surface 56 about the periphery of aperture 48 due to the bias of spring 54. However, when the lower end 104 of the probe engages the workpiece strip 20, the probe moves upwardly such that the control surface 102 cams the push rod end 100 to the right to unseat rod flange 98 from the seat 96 against the bias of spring 97 as the first push rod end 92 depresses switch plunger 78 to actuate the switch 66. Actuation of switch 66 generates the electrical signal in the wires 86 so as to permit the stamping operation to be shut down prior to die breakage.

While a preferred embodiment of the progressive die sensor has herein been described in detail, those familiar with the art will recognize various alternative designs and embodiments for practicing the present invention as defined by the following claims.

What is claimed is:

1. A progressive die sensor comprising: a housing for mounting on an upper punch holder; said housing including opposite side surfaces and an upper mounting surface that engages the upper punch holder when the housing is mounted thereon; a depression that opens upwardly in the housing along the mounting surface thereof and has opposite sides opening to the side surfaces of the housing and a rectangular cross section therebetween; means for mounting a downwardly extending probe on the housing in a spaced relationship from the depression for relative movement that indicates an unaligned workpiece condition; a switch received within the depression and including an actuating plunger; a switch cover secured within the housing depression and having downwardly extending side portions of rectangular cross sections between which the switch is received; said switch cover including an upper surface that defines a continuation of the upper mounting surface of the housing and which engages the punch holder along with the housing mounting surface during mounting thereon; said side portions of the switch cover including surfaces that form a continuation of the housing side surfaces at the opposite sides of the depression; means for positioning the switch with respect to the housing and the cover in the depression; and a push rod extending between the probe and the switch plunger to actuate the switch in response to probe movement indicating an unaligned workpiece condition such that an electrical signal may be generated when such a condition occurs.

2. A sensor comprising: a housing for mounting on an upper punch holder; said housing including lateral side surfaces and an upper mounting surface that engages the upper punch holder when the housing is mounted thereon; an upwardly opening depression in the housing that has opposite sides opening to the lateral side surfaces of the housing; means for mounting a downwardly extending probe on the housing in a spaced relationship from the depression for relative movement that indicates an unaligned workpiece condition; a switch received within the depression and including an actuating plunger; a switch cover secured within the housing depression to cover the switch; the switch cover including downwardly extending side portions adjacent the opposite sides of the depression; said side portions being spaced with respect to each other to receive the switch therebetween; posts that extend between the switch and the cover intermediate the downwardly extending cover side portions to position the switch with respect to the housing and the switch cover; a push rod extending between the probe and the switch plunger to actuate the switch in response to probe movement indicating an unaligned workpiece condition such that an electrical signal may be generated when such a condition occurs.

3. A sensor as in cliam 2 wherein the depression in the housing has a rectangular cross section between the opposite sides thereof, and the side portions of the cover having rectangular shapes closing the opposite sides of the depression.

4. A sensor as in claim 3 further including a gasket that seals between the side portions of the cover and the opposite sides of the housing depression.

5. A sensor as in cliam 3 wherein the housing includes a push rod hole receiving the push rod and opening to the depression between the side portions of the cover.

6. A sensor as in claim 5 wherein the push rod includes an annular flange, the push rod hole in the housing including a seat; and a spring for normally engaging the push rod flange with the seat.

7. A sensor as in claim 2 wherein the housing includes a rounded end that mounts the probe and a squared end having an electrical cable hole that communicates with the depression and the environment to allow a cable to be connected to the switch and to carry an electrical signal from the switch indicating an unaligned workpiece condition.

* * * * *